US006590990B2

(12) United States Patent
Abe et al.

(10) Patent No.: US 6,590,990 B2
(45) Date of Patent: Jul. 8, 2003

(54) SPEAKER APPARATUS

(75) Inventors: Yasuhisa Abe, Tendo (JP); Takashi Suzuki, Tendo (JP); Koji Matsumoto, Tendo (JP)

(73) Assignees: Pioneer Corporation, Tokyo (JP); Tohoku Pioneer Corporation, Tendo (JP)

( * ) Notice: Subject to any disclaimer, the term of this patent is extended or adjusted under 35 U.S.C. 154(b) by 0 days.

(21) Appl. No.: 09/973,071

(22) Filed: Oct. 10, 2001

(65) Prior Publication Data

US 2002/0067843 A1 Jun. 6, 2002

(30) Foreign Application Priority Data

Oct. 31, 2000 (JP) ..... 2000-332298

(51) Int. Cl.[7] ..... H04R 25/00
(52) U.S. Cl. ..... 381/407; 381/397; 381/400

(58) Field of Search ..... 381/396, 397, 381/407, 400, 423, 427, FOR 152, 186

(56) References Cited

U.S. PATENT DOCUMENTS

| | | | | | |
|---|---|---|---|---|---|
| 2,231,479 | A | * | 2/1941 | Perry | 381/186 |
| 2,295,483 | A | * | 9/1942 | Knowles | 381/397 |
| 3,358,088 | A | * | 12/1967 | Gault | 381/407 |
| 4,427,846 | A | * | 1/1984 | Millward | 381/407 |
| 5,357,586 | A | * | 10/1994 | Nordschow et al. | 381/397 |

* cited by examiner

*Primary Examiner*—Huyen Le
(74) *Attorney, Agent, or Firm*—Morgan, Lewis & Bockius LLP

(57) ABSTRACT

The invention relates to a speaker that can cool a voice coil efficiently. A bobbin that supports the voice coil is made from a material having good thermal transfer characteristics. Slits are formed in the bobbin to further promote heat emission from the voice coil.

8 Claims, 3 Drawing Sheets

SPEAKER APPARATUS

BACKGROUND OF THE INVENTION

1. Field of the Invention

The present invention relates to a speaker apparatus having a cone-shaped diaphragm.

2. Description of the Related Art

Referring to FIG. 1 of the accompanying drawings, illustrated is a conventional speaker apparatus that includes a cone-shaped diaphragm.

This speaker apparatus includes a back plate 1 that has a pole piece 2 extending from a center portion thereof, and a magnet 3 that is located on an annular support portion of the back plate 1. A top plate 4 is placed on the magnet 3 such that a magnetic gap is created between the top plate 4 and pole piece 2. A bobbin 6 that carries a voice coil 5 is positioned in the magnetic gap. The voice coil bobbin 6 is supported for oscillation by a frame 8 via a damper 7. A center portion of a cone-shaped diaphragm 9 is connected to the voice coil bobbin 6. A conical center cap 10 is provided at a top of the voice coil bobbin 6.

The voice coil 5 vibrates (oscillates) together with the bobbin 6 in response to a sound/voice signal current supplied to the voice coil 5. This in turn vibrates the cone-shaped diaphragm 9 and generates a sound.

The sound/voice signal current flows in the voice coil 5 so that heat is generated in the voice coil 5. The above described speaker apparatus therefore suffers from a deteriorated sound quality, which is caused by the heat generated from the voice coil.

SUMMARY OF THE INVENTION

The present invention is developed to solve the above described problems, and intends to cool the voice coil efficiently and insure a good sound quality.

According to one aspect of the present invention, there is provided a speaker apparatus including a cone-shaped diaphragm, a voice coil bobbin connected to the diaphragm and made from a material having good thermal transfer characteristics, slits formed in the bobbin, a magnetic circuit for applying a magnetic field to the voice coil, and a center cap placed on a top of the bobbin and made from a material having good heat transfer characteristics.

DETAILED DESCRIPTION OF THE INVENTION

Embodiments of the present invention will be described in reference to the accompanying drawings.

Figure 1:
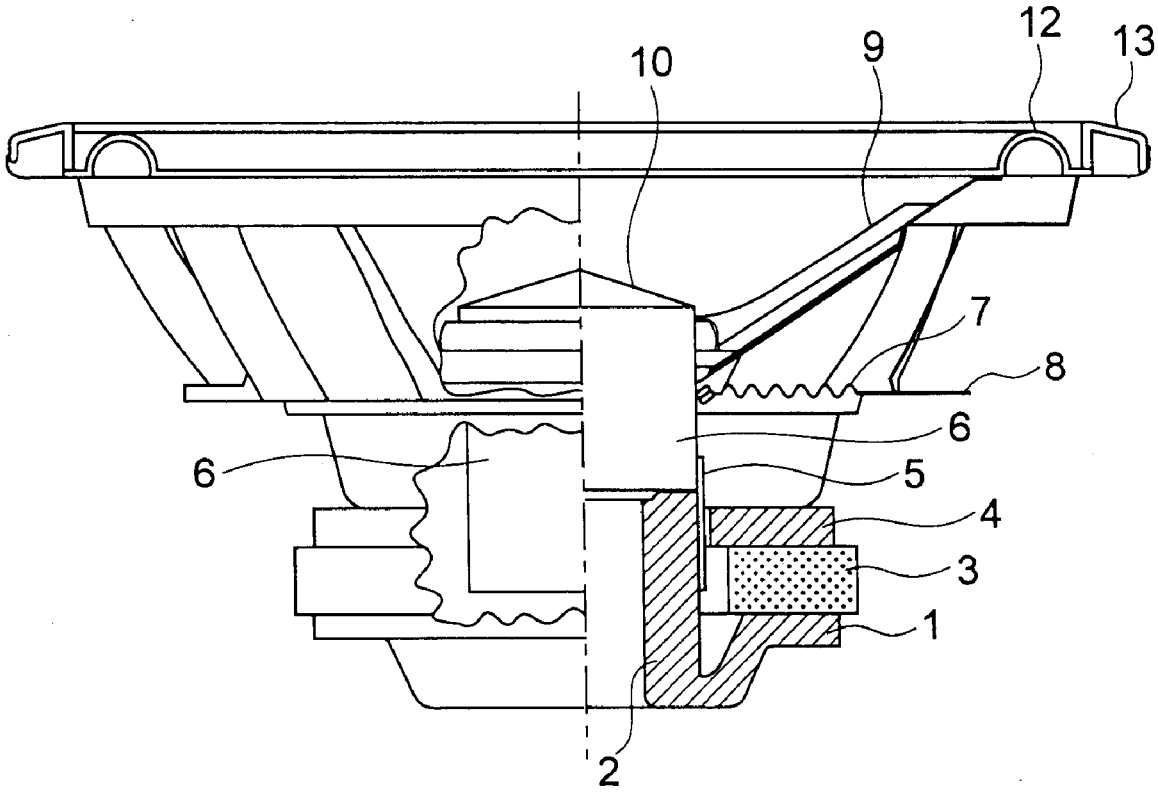
FIG. 1 PRIOR ART
FIG. 1 illustrates a cross sectional view of a conventional speaker apparatus.
Figure 2:
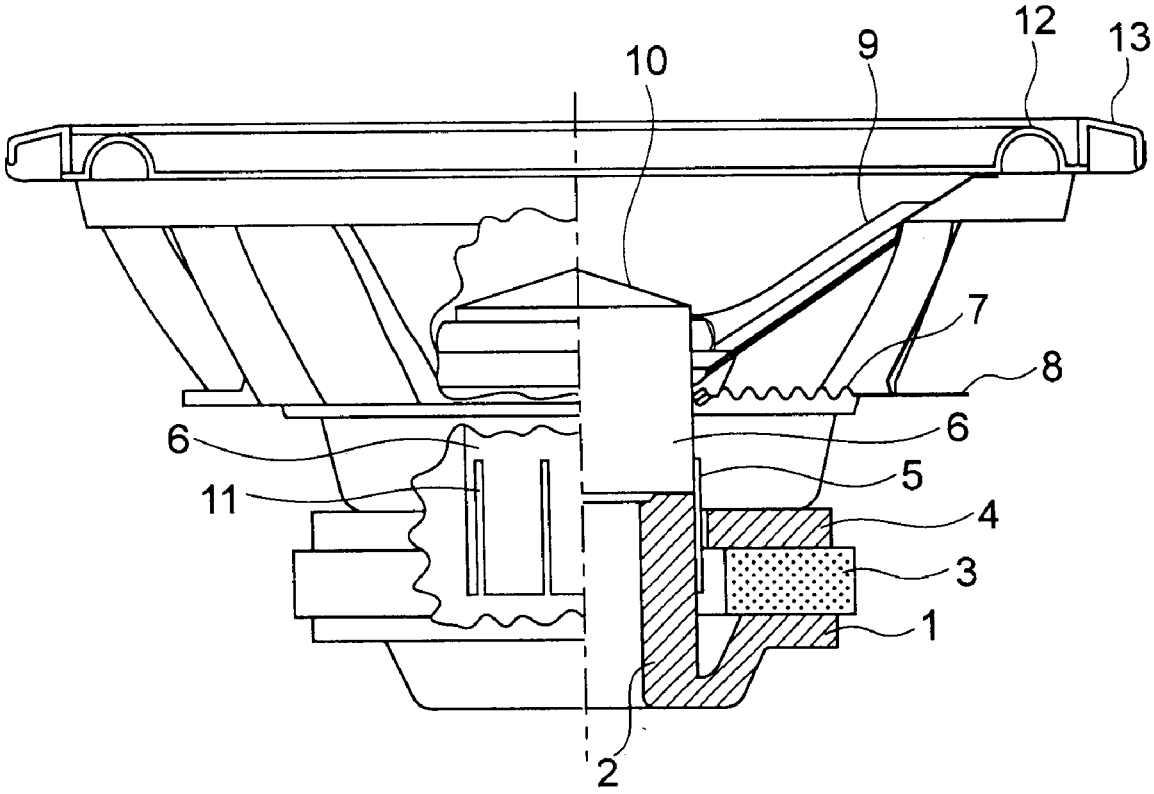
FIG. 2 illustrates a cross sectional view of a speaker apparatus according to a first embodiment of the present invention.

FIG. 2 illustrates a speaker apparatus according to a first embodiment of the invention, and similar reference numerals are used to designate similar elements in FIGS. 1 and 2.

As shown in FIG. 2, a back plate 1 of the speaker apparatus has a pole piece 2 extending upwards from a center portion of the back plate, and a magnet 3 is located on an annular support portion of the back plate 1. A top plate 4 is placed on the magnet 3 such that a magnetic gap is formed between the top plate 4 and pole piece 2. A bobbin 6 that supports a voice coil 5 is positioned to oscillate in the magnetic gap. In order to effectively use a magnetic flux in the magnetic gap and increase an efficiency, the voice coil 5 is wound around the bobbin 6 such that the height of the voice coil 5 becomes greater than the magnetic gap. The voice coil bobbin 6 is supported by a frame 8 via a damper 7. The voice coil bobbin 6 is made from a material, such as aluminum, which has good heat transfer characteristics in order to sufficiently emit heat generated from the voice coil 5. The voice coil bobbin 6 has a plurality of slits 11 at predetermined intervals in a direction perpendicular to the winding direction of the voice coil 5, i.e., in the oscillating direction. Each of the slits 11 has an open lower end. A center portion of a cone-shaped diaphragm 9 is connected to the voice coil bobbin 6. A conical center cap 10 is provided at a top of the bobbin 6. Like the bobbin 6, the center cap 10 is made from a material having a good heat transfer coefficient, such as aluminum. Therefore, the speaker apparatus of this embodiment has a structure that facilitates heat emission. A closed periphery of the cone-shaped diaphragm 9 is supported at an edge 12 firmly secured to the frame 8 via a gasket 13.

Now, an operation of the speaker apparatus will be described. An upwards or downwards drive force is applied to the voice coil 5 when a current flows in the voice coil 5 located in the magnetic gap. The direction of the drive force is determined by the direction of the current. Since the voice coil 5 is movable, the drive force applied to the voice coil 5 is transmitted to the diaphragm 9 via the bobbin 6. Because the bobbin 6 has the slits 11, the air in the magnetic gap is agitated as the bobbin 6 moves. The agitated air can efficiently cool the voice coil 5. This also reduces an eddy current generated in the bobbin 6. The slits 11 are higher than the voice coil 5 (upper portions of the slits 11 are not covered with the voice coil) in this embodiment so that upper portions of the slits 11 serve as ventilation openings. Accordingly, the voice coil 5 can be cooled quite effectively. It should be noted, however, that the winding voice coil 5 may completely cover the slits 11.

Figure 3:
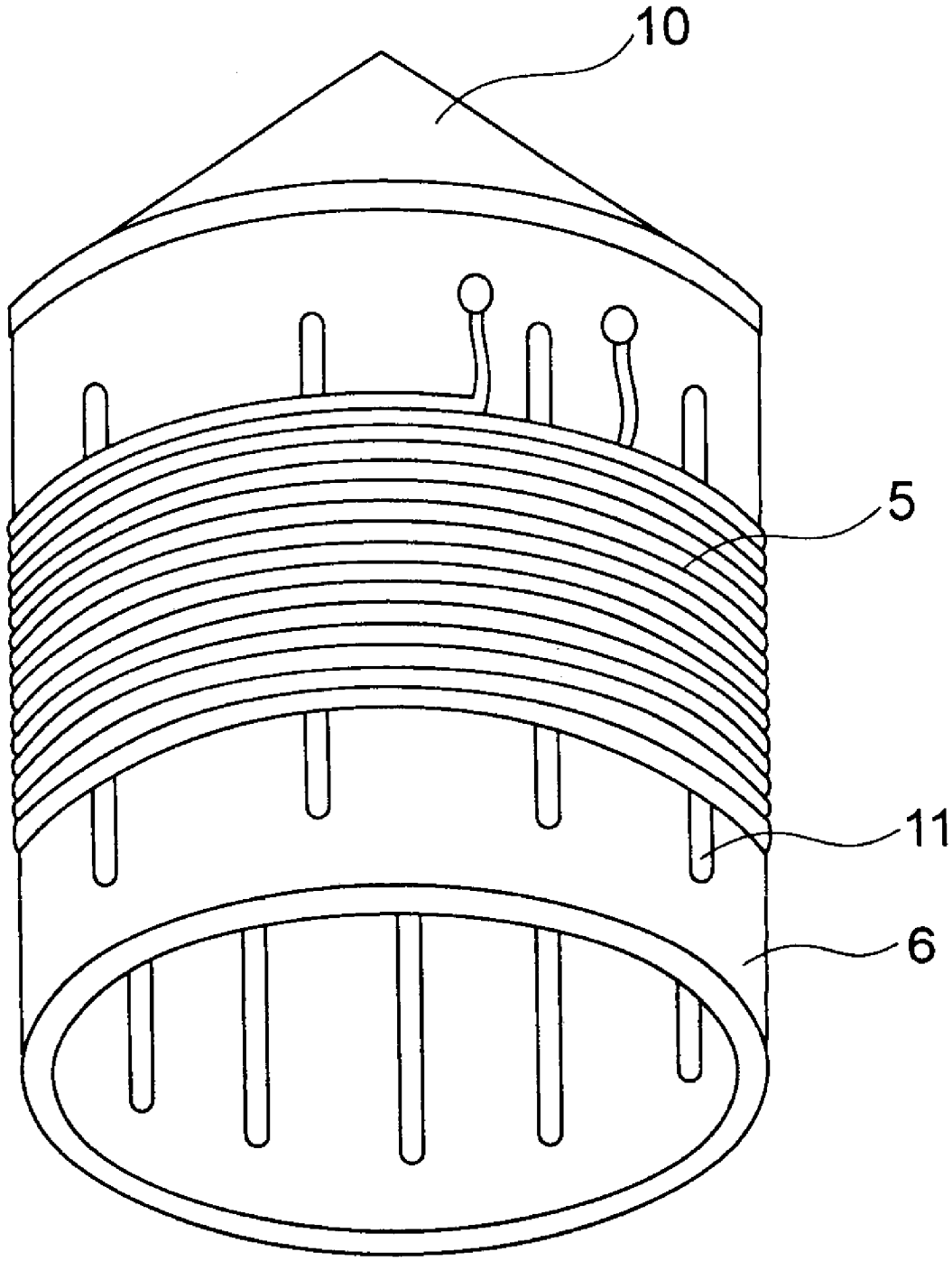
FIG. 3 illustrates a perspective view of a bobbin and a center cap employed in a second embodiment of the present invention.

Referring to FIG. 3, illustrated are the bobbin 6 and center cap 10 according to a second embodiment of the present invention. A plurality of slits 11 are formed at predetermined intervals, and upper and lower portions of the slits 11 are not covered with the voice coil 5. This increases the cooling efficiency of the voice coil 5. Each of the slits 11 has closed upper and lower ends to ensure rigidity of the bobbin 6. It should be noted that the slits 11 are not necessarily formed in parallel to the oscillating direction. In other words, the slits 11 may extend at a certain angle relative to the oscillating direction. Further, the bobbin 6 and center cap 10 may be fabricated integrally (as a one piece element) to further increase the cooling efficiency.

As understood from the foregoing, the speaker apparatus of the invention can cool the voice coil efficiently since the bobbin and center cap are made from a material having a high thermal transfer coefficient. In addition, the slits formed in the bobbin facilitate the cooling of the voice coil and reduce the eddy current to be produced in the bobbin.

The above described speaker apparatus is disclosed in Japanese Patent Application No. 2000-332298, the instant application is based on this Japanese Patent Application, and the entire disclosure thereof is incorporated herein by reference.

What is claimed is:

1. A speaker apparatus comprising:

a cone-shaped diaphragm;

a bobbin connected to the diaphragm and made from a material having good heat transfer characteristics, with a voice coil being supported by the bobbin;

at least one slit formed in the bobbin, wherein the at least one slit is partially overlapped by the voice coil, the at least one slit having an upper portion that extends higher than the voice coil;

a magnetic circuit for applying a magnetic field to the voice coil; and a center cap provided on a top of the bobbin and made from a material having good heat transfer characteristics.

2. The speaker apparatus according to claim 1, wherein the bobbin is made from aluminum.

3. The speaker apparatus according to claim 2, wherein the center cap is made from aluminum.

4. The speaker apparatus according to claim 1, wherein the at least one slit is elongated in an oscillating direction of the diaphragm.

5. The speaker apparatus according to claim 1, wherein the at least one slit has closed ends.

6. The speaker apparatus according to claim 1, wherein the at least one slit has an open lower end.

7. The speaker apparatus according to claim 1, wherein the at least one slit is provided at an angle relative to an oscillating direction of the diaphragm.

8. The speaker apparatus according to claim 1, wherein the height of the voice coil is greater than the magnetic gap between a top plate and a pole piece of the speaker apparatus.

* * * * *